United States Patent [19]

Smith

[11] 4,316,555

[45] Feb. 23, 1982

[54] SYSTEM FOR DISPENSING FLUIDS

[75] Inventor: Randel P. Smith, Chicago, Ill.

[73] Assignee: Steiner Corporation, Salt Lake City, Utah

[21] Appl. No.: 126,420

[22] Filed: Mar. 3, 1980

[51] Int. Cl.[3] ..... B67B 7/28

[52] U.S. Cl. ..... 222/83.5; 222/105

[58] Field of Search ..... 222/82, 83, 83.5, 181, 222/105, 80, 81, 88, 566

[56] References Cited

U.S. PATENT DOCUMENTS

| | | | |
|---|---|---|---|
| 2,849,321 | 8/1958 | Lhermitte et al. | 99/171 |
| 3,128,913 | 4/1964 | Specketer | 222/566 X |
| 3,220,588 | 11/1965 | Lipari | 215/11 |
| 3,255,923 | 6/1966 | Soto | 222/80 |
| 3,596,801 | 8/1971 | Barnack | 222/81 |
| 4,149,573 | 4/1979 | Cassia | 141/18 |
| 4,214,676 | 7/1980 | Cassia | 222/83.5 |

*Primary Examiner*—Stanley H. Tollberg

*Attorney, Agent, or Firm*—Dithmar, Stotland, Stratman & Levy

[57] ABSTRACT

A system for dispensing fluids including a closed container having a manually actuated dispensing pump carried therebeneath, the container being separated by a partition into a lower reservoir compartment and an upper refill compartment, the latter adapted to enclose therein a removable refill pouch; a refill well is provided in the partition and disposed in the refill well is a hollow tubular member extending upwardly thereinto with a refill aperture extending therethrough; the refill pouch has a flexible wall hermetically sealed and containing fluid, and a docking adaptor loosely disposed within the pouch for insertion into the refill well so as to push the wall of the pouch upon the piercing member to pierce the wall to provide an opening for discharge of fluid from the pouch through the refill aperture and into the lower reservoir compartment; a slot in the wall in the upper refill compartment prevents accumulation of free fluid therein.

20 Claims, 9 Drawing Figures

100
50
53
109
183
200
181
180
174
176
182
187
186
170
171
195
184
119
118
172
103
104
105
51
55
52
101
190
6.
201
168
175
177
213
215
211
210
205
150
166
164
158
212
163
122
165
120
151
153
154
162
156
161
160
206
157
167
121
123
141
143
144
125
110
132
134
135
145
146
147
112
140
129
128
113
114
111
115
130
131

210
213
217
211
215
5.
216

211
216
212
215
210
217

FIG. 6
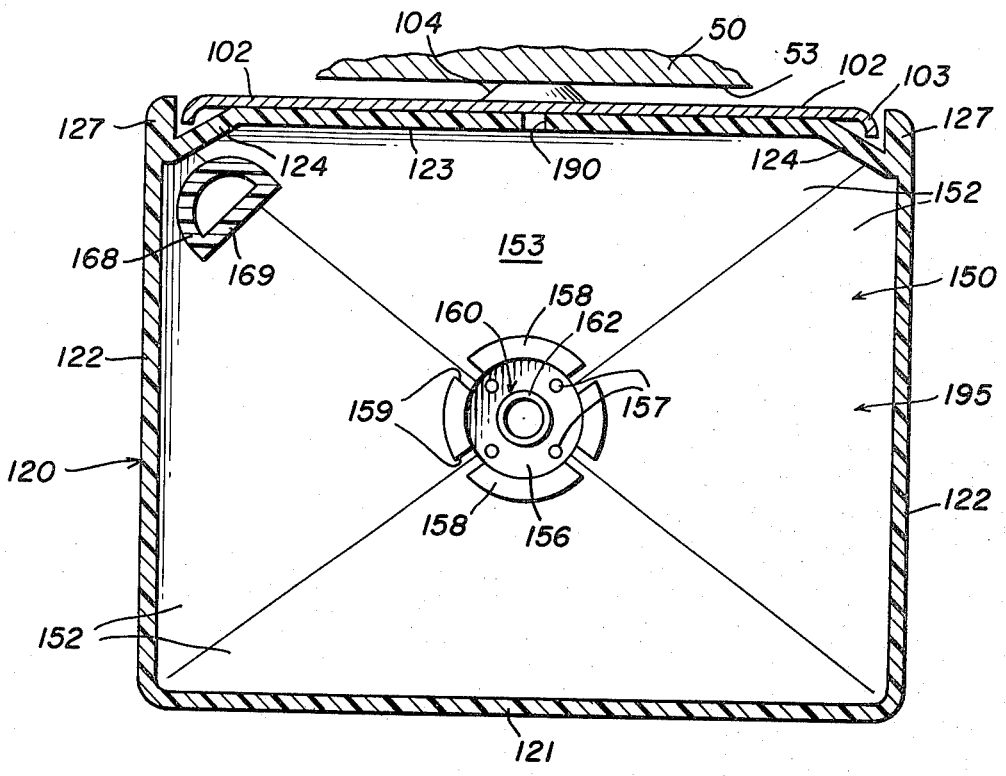
FIG. 7
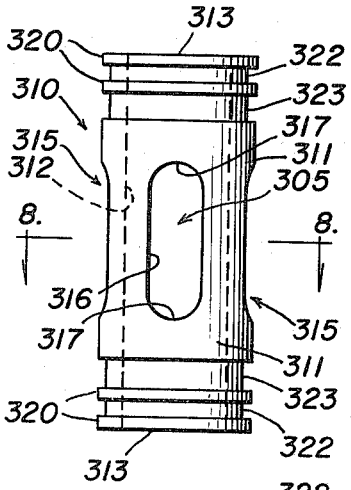
FIG. 9
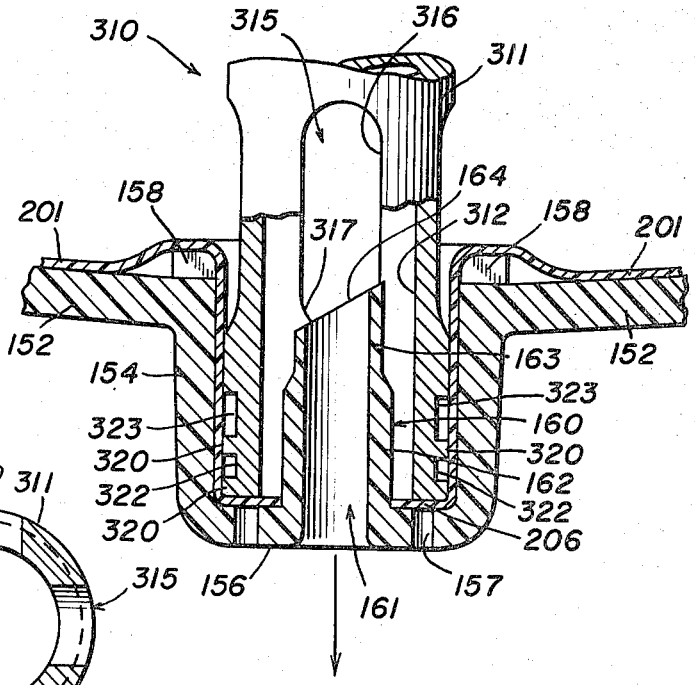
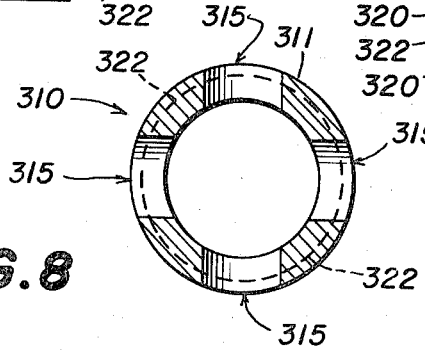
FIG. 8

SYSTEM FOR DISPENSING FLUIDS

BACKGROUND OF THE INVENTION

The present invention relates to a system for dispensing fluids, such as liquid soap, wherein the dispenser includes a lower reservoir compartment for the fluid to be dispensed and an upper refill compartment containing a fluid refill pouch in controlled communication with the lower reservoir compartment.

This invention is an improvement upon the systems for dispensing fluids disclosed and claimed in an application for U.S. Letters Patent, Ser. No. 10,013, filed Feb. 7, 1979 by Randel P. Smith for Fluid Injection Pouch And Dispensing System Incorporating The Same, the disclosure of that prior application being incorporated herein in its entirety by reference, and an application for U.S. Letters Patent, Ser. No. 150,556, filed May 16, 1980 by Antonio Macchi Cassia for Soap Dispensing System, the disclosure of the latter prior application being also incorporated herein in its entirety by reference.

The present invention is also an improvement upon U.S. Pat. No. 4,149,573, assigned to the assignee of the present invention. In the system of that patent, a container is provided with a refill aperture which is dimensioned so that at equal pressures inside and outside the container, liquid soap will flow therethrough only very slowly. Thus, in refilling the container, a special squeeze-bottle type refill cartridge or flexible walled fluid injection pouch cartridge is used in order to force the soap through the refill aperture, the cartridge outlet being closed by a pierceable membrane which is ruptured by a piercing member adjacent to the refill aperture to permit the flow of fluids from the refill cartridge.

While these prior dispensing systems work effectively, it has been found that an inconveniently long time is required for a service man to squeeze the contents of the refill cartridge into the reservoir of the dispenser. Generally, quite a few squeezes of the refill cartridge are necessary in order completely to empty it, and if the service man does not completely empty the cartridge, considerable soap wastage results.

Also, these prior systems have the disadvantage of leaving the refill aperture and the piercing member exposed to the atmosphere and possible contamination by dust and the like between refills.

Furthermore, in the case of an opaque container for soap on the dispenser, it is not possible readily to determine the amount of liquid soap left therein so as to know whether or not a refill is necessary.

There also have been provided heretofore flexible refill pouches for fluids with puncture structure therein, and typical structures are shown in U.S. Pat. No. 2,849,321 granted Aug. 26, 1958 to Y. Lhermitte et al., U.S. Pat. No. 3,220,588 granted Nov. 30, 1965 to M. Lipari, U.S. Pat. No. 3,255,923 granted June 14, 1966 to R. H. Soto, and U.S. Pat. No. 3,596,801 granted Aug. 3, 1971 to H. C. Barnack. None of these prior pouch systems and the puncture or adaptor structures therein was intended and designed to be used in conjunction with the refill well of an associated dispenser of the type disclosed and claimed herein.

SUMMARY OF THE INVENTION

The present invention provides a system for dispensing fluids, such as liquid soap, which includes a refillable dispenser, and which provides a lower reservoir compartment for the fluid and an upper refill compartment containing a fluid refill pouch in close communication with the lower reservoir compartment.

This is accomplished in the present invention, and it is an object of the present invention to acomplish these desired results, by providing a system for dispensing fluid including a closed wall structure defining a container, partition means separating the container into a lower reservoir compartment and an upper refill compartment, dispensing means carried by the container for dispensing fluid from the lower compartment, the partition means having a refill well therein including a side wall portion extending into the lower compartment and an inner wall portion closing the inner end of the side wall portion, a piercing member carried by the inner wall portion and projecting therefrom into the refill well, the inner well portion having a refill aperture therethrough providing direct communication between the lower compartment and the upper compartment, a fluid refill pouch removably enclosed within the upper compartment in a refill configuration, the fluid refill pouch including a flexible encompassing wall sealed to form a hollow flexible container with a quantity of fluid therein, and a docking adaptor initially loosely disposed within the pouch and including an outer wall having an outer size slightly less than the inner size of the side wall portion of the refill well so as to fit thereinto with the flexible wall of the pouch disposed between the inner surface of the side wall portion of the refill well and the outer surface of the outer wall to form a seal therebetween, the docking adaptor including an inner wall having an inner size slightly greater than the lateral extent of the piercing member so that the docking adaptor can be pushed into the well and over the piercing member, a portion of the flexible wall overlying the end of the docking adaptor as it is inserted into the refill well receiving the piercing member in piercing relationship therethrough.

Another object of the invention is to provide a system for dispensing fluid of the type set forth which accommodates free flow of the fluid from the refill pouch through the refill aperture into the lower reservoir compartment of the container.

Yet another object of the invention is to provide a system for dispensing fluid of the type set forth, wherein the refill operation requires very little of a service man's time in order to accomplish the refill operation.

Another object of the invention is the provision of a system for dispensing fluid of the type set forth which includes a refillable fluid container having an upper refill compartment therein in which a refill pouch may be enclosed and left in place in communication with the lower reservoir compartment thereof.

Still another object of the invention is to provide a system for dispensing fluid of the type set forth wherein the docking adaptor has an essentially smooth outer wall cooperating with the inner surface of the side wall portion of the associated refill well and a layer of the flexible pouch wall disposed therebetween to form a seal during the refill operation.

A further object of the invention is to provide a system for dispensing fluid of the type set forth wherein the docking adaptor includes an annular flexible sealing means projecting radially outwardly from the docking adaptor and being dimensioned and adapted to be received in the refill well of the associated dispenser in encircling relationship with the refill aperture and the piercing member thereof and with the sealing means pressing the adjacent flexible wall into sealing engagement of the side wall portion of the associated refill well.

Further features of the invention pertain to the particular arrangement of the parts of the system for dispensing fluid, whereby the above outlined and additional operating features thereof are attained.

The invention both as to its organization and method of operation, together with further features and advantages thereof will best be understood with reference to the following specification taken in connection with the accompanying drawings.

BRIEF DESCRIPTION OF THE DRAWINGS

FIG. 6 is a view in horizontal section taken along the line 6—6 of FIG. 3;

FIG. 7 is a side elevational view of a second form of tubular docking adaptor useful in the fluid refill pouch of the present invention;

FIG. 8 is a view in horizontal section along the line 8—8 of FIG. 7; and FIG. 9 is an enlarged view illustrating the cooperation between the tubular docking adaptor of FIG. 7 and the wall of the associated refill pouch after insertion thereof into an associated refill well of a dispenser.

DESCRIPTION OF THE PREFERRED EMBODIMENTS

Figure 1:
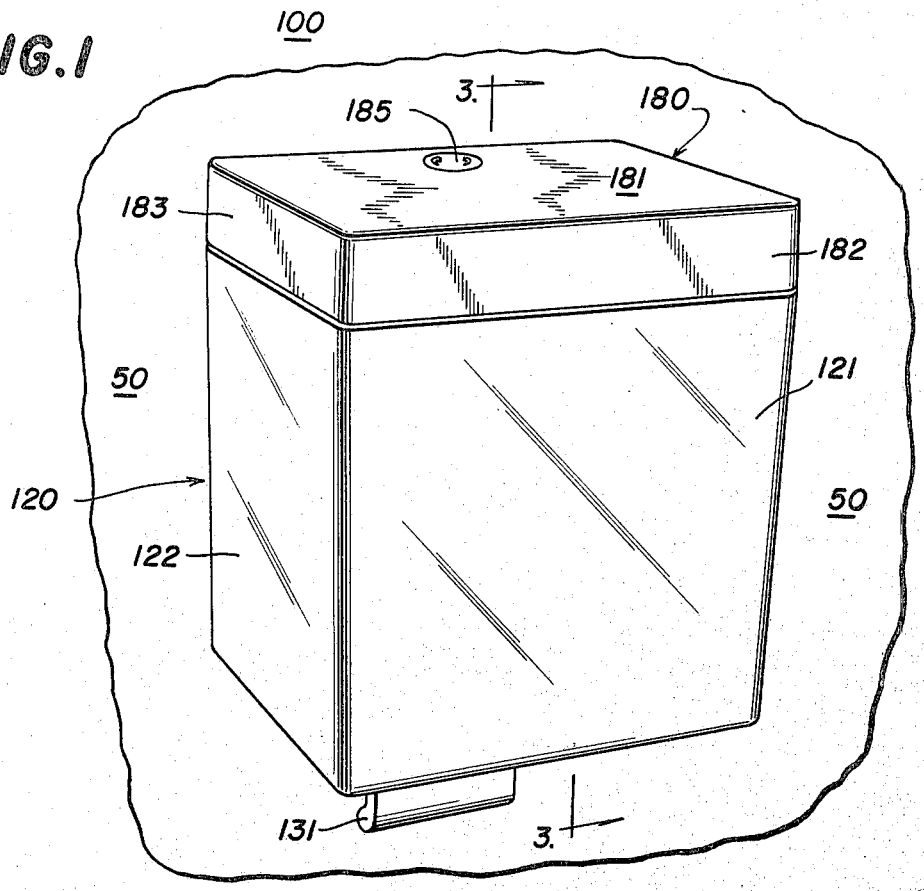
FIG. 1 is a front perspective view of a fluid dispenser constructed in accordance with and embodying the principles of the present invention.
Figure 3:
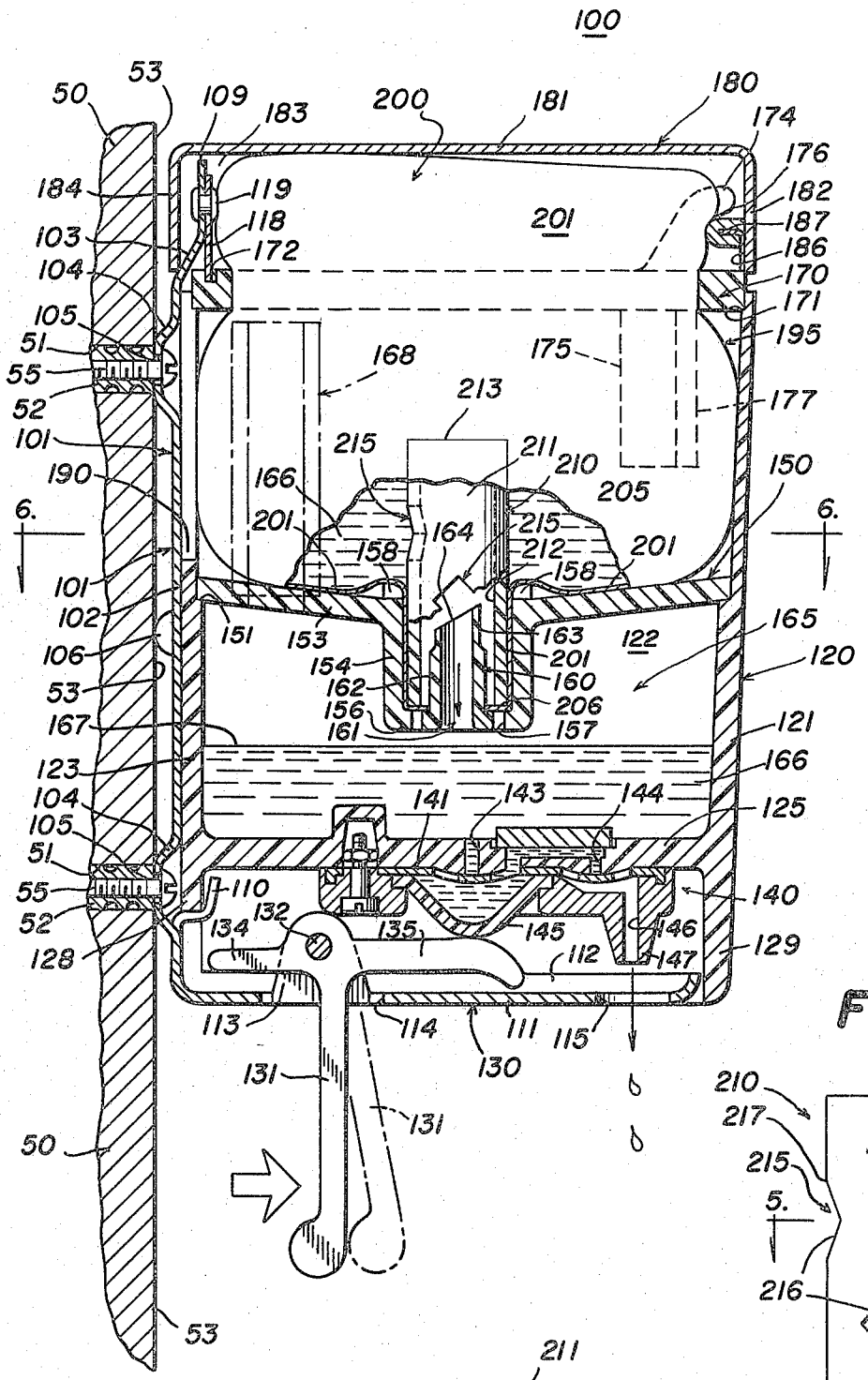
FIG. 3 is an enlarged view in vertical section taken along the line 3—3 in FIG. 1 and illustrating the internal construction of the dispenser.

Referring to FIGS. 1, 3 and 6 of the drawings, there is illustrated a dispenser 100, constructed in accordance with and embodying the features of the present invention.

The dispenser 100 is useful with a wide variety of fluids, but is particularly useful in dispensing soap, whereby the dispensing of soap by the dispenser 100 will be used for illustrative purposes hereafter.

The soap dispenser 100 includes a mounting bracket, generally designated by the numeral 101, which includes a generally flat rectangular wall 102 disposed substantially vertically in use to provide a bearing surface and having along each of the side edges thereof an integral curved side flange 103 which projects forwardly from the wall 102. Formed in the vertical wall 102 and projecting rearwardly therefrom in a direction away from the direction in which the side flanges 103 extend, are two substantially vertically aligned embossments 104, each having an opening 105 extending therethrough centrally thereof. Also formed in the wall 102 projecting rearwardly therefrom are two embossments 106 (only one being shown) which are disposed substantially in horizontal alignment with each other along a line disposed substantially midway between the embossments 104, with the embossments 106 projecting the same distance as the embossments 104, and each having an opening (not shown) extending therethrough centrally thereof.

Integral with the wall 102 at the upper end thereof is an extension flange 108 which is inclined forwardly in the same general direction as the side flanges 103, and which is integral at the distal end thereof with an upwardly extending flange 109 which is substantially parallel to the wall 102. Punched from the wall 102 adjacent to the forward end thereof are two forwardly and upwardly extending support fingers 110.

Integral with the bottom end of the wall 101 and extending forwardly therefrom substantially normal thereto is the wall 111 which is disposed substantially horizontally in use and is provided around the periphery thereof with an integral upturned flange 112, which is in turn integral with the side flanges 103. Integral with the wall 111 and projecting upwardly therefrom substantially normal thereto are two parallel and laterally spaced-apart pivot brackets 113, a portion of the wall 111 between the pivot brackets 113 being cut out to define a generally rectangular opening 114. Formed in the wall 111 adjacent to the forward edge thereof and substantially midway between the side edges thereof is a circular soap discharge opening 115, the purposes of the openings 114 and 115 being described more fully hereinafter. A circular retaining plate 118 is pivotally secured to the inner surface of the upwardly extending flange 109 as by a rivet 119.

In use, the mounting bracket 101 is mounted on the wall 50, generally above and closely adjacent to a sink or wash basin or the like. Mounting openings or holes 51 are formed in the wall 50 and may have screw fastening inserts 52 set therein. The mounting bracket 101 is fixedly secured to the wall 50 by means of mounting screws 55 which are passed through the openings in the embossments 104 or 106 and threadedly engaged in the inserts 52, the wall 102 being disposed substantially parallel to the surface 53 of the wall 50, and being in contact therewith only at the embossments 104 and 106, which serve to space the mounting bracket 101 a slight distance from the surface 53 of the wall 50.

The dispenser 100 also includes a soap container or housing generally designated by the numeral 120, which is preferably formed of a translucent or transparent plastic, although it will be understood that any suitable material either opaque or light transmitting can be used. The container 120 is generally box-like in configuration and includes a generally rectangular front wall 121, a pair of opposed side walls 122, a rear wall 123 and a rectangular bottom wall 125, the container 120 preferably being molded so that the walls 121, 122, 123 and 125 are all formed integrally with one another. The rear wall 123 is provided at the lateral side edges thereof with inturned forwardly inclined portions 124. The side walls 122 have rearwardly extending portions 127 which project rearwardly beyond the rear wall 123, whereby the rear wall 123 is recessed with respect to the side walls 122. In addition, the rear wall 123 extends downwardly below the bottom wall 125 to form a downwardly extending portion or mounting flange 128. Similarly, the front wall 121 of the side walls 122 all extend downwardly well below the bottom wall 125 and below the bottom edge of the mounting flange 128 to form a skirt 129.

Mounted below the bottom wall 125 of the container 120 is a pump assembly generally designated by the numeral 130. The operation and construction of the pump assembly 130 is described in detail in U.S. Pat.

No. 4,018,363, issued Apr. 19, 1977 to Antonio Macchi Cassia, and assigned to the assignee of the present invention, the disclosure of which patent is incorporated herein by reference. The pump assembly 130 includes an operating handle 131 provided with a pivot pin 132, the opposite ends of which are respectively mounted in the pivot brackets 113 on the mounting bracket wall 111 for pivotal movement of the operating handle 131 about the axis of the pivot pin 132, which extends substantially horizontally above the bracket wall 111 substantially parallel thereto and to the bracket wall 102. The handle 131 projects in use downwardly through the opening 114 in the bracket wall 111 and terminates at the lower end thereof in an enlarged gripping portion. The handle 131 also includes a stop member 134 which projects rearwardly from the pin 132 above the housing wall 111, and an actuating arm 135 which projects forwardly from the pin 132 above the bracket wall 111 and is substantially longer than the stop member 134.

The pump assembly 130 also includes a unitary pump housing 140, which is preferably of molded construction. The pump housing 140 is fixedly secured to the bottom wall 125 of the container 120 by suitable fasteners. Securely sandwiched between the pump housing 140 and the bottom wall 125 of the container 120 is a flexible diaphragm 141 having a plurality of suction apertures therethrough in surrounding relationship with a suction conduit or opening 143 in the bottom wall 135 of the container 120. The diaphragm 141 also has a plurality of discharge apertures therein disposed in surrounding relationship with a discharge conduit 144 in the bottom wall 125. A flexible resilient bowl 145 is disposed below the diaphragm 141 in the region of the suction conduit 143, the outer surface of the bowl 145 normally just touching the actuating arm 135 when the handle 131 is in its normal rest position illustrated by solid lines in FIG. 3. Disposed below the diaphragm 141 in the region of the discharge conduit 144 is a delivery conduit 146 in a spout 147 disposed immediately above and in alignment with the soap discharge opening 115 in the mounting bracket wall 111. A channel provides communication between the bowl 145 and the discharge conduit 144. In operation, the soap container 120 is mounted on the mounting bracket 101 in a manner which is fully explained in the aforementioned U.S. Pat. No. 4,149,573, the disclosure of which is incorporated herein by reference. The operating handle 131 is pulled forwardly by a user from the solid line position thereof to the dashed line position thereof in FIG. 3, thereby to compress the bowl 145 with the actuating arm 135 and expel a predetermined quantity of liquid soap from the delivery conduit 146, release of the operating handle 131 permitting re-expansion of the bowl 145 thereby to suck a fresh charge of liquid soap from the container 120 through the suction conduit 143 in preparation for the next dispensing operation, all as is more fully explained in the aforementioned U.S. Pat. Nos. 4,018,363 and 4,149,573.

It is an important feature of the invention that there is provided in the soap container 120 a partition, generally designated by the numeral 150, which is disposed generally horizontally in use, the partition 150 being substantially rectangular in shape with the peripheral edges thereof resting upon a ledge 151 formed in the inner surfaces of the soap container walls 121 to 123 and fixedly secured thereto as by ultrasonic welding. The partition 150 comprises four generally triangular sectors 152, the upper surfaces 153 of which slope generally downwardly toward the center of the partition 150 at which there is formed a refill well, generally designated by the numeral 155. The refill well 155 includes a cylindrical side wall 154 integral at the upper end thereof with the partition 150 and extending downwardly therebelow, the lower end thereof being terminated by a circular bottom wall 156. Formed in the bottom wall 156 adjacent the outer edge thereof are four equiangularly spaced-apart small drain holes 157. Integral with the upper surface 153 of the partition 150 around the upper perimeter of the well 155 is an annular rim 158 having notches 159 formed therein respectively at the junctions of the triangular sectors 152.

Integral with the bottom wall 156 of the refill well 155 and extending upwardly therefrom centrally thereof and coaxially with the cylindrical side wall 154 is a hollow tubular piercing member, generally designated by the numeral 160. The lower end of the piercing member 160 surrounds the complementarily shaped opening in the bottom wall 156 and cooperates therewith to define a refill passage or aperture 161 through the refill well 155. The outer surface 162 of the piercing member 160 has a reduced diameter upper portion 163, the piercing member 160 having a bevelled tip 164 at its upper end, the upper edge of which presents a sharp piercing edge.

It will be seen that the partition 150 cooperates with the bottom wall 125 and the walls 121 to 123 of the container 120 to define therebetween a liquid soap reservoir in a lower reservoir compartment, generally designated by the numeral 165, which is adapted to be filled with a quantity of liquid soap 166 to a level 167, the position of the partition 150 in the soap container 120 being such that the reservoir 165 occupies slightly less than half of the interior volume of the container 120. Fixedly secured to the partition 150 adjacent the one corner thereof and extending vertically therefrom and terminating adjacent to the upper end of the container 120 is a hollow vent tube 168, the lower end of which communicates with a vent opening formed through the partition 150. The vent tube 168 is generally semi-circular in transverse cross section and has a flat rectangular retaining surface 169 thereon facing inwardly toward the refill well 155 and disposed generally at a 45° angle to the rear wall 123 and the adjacent side wall 122.

The container 120 is also provided with a top plate, generally designated by the numeral 170, and the outer perimeter of which is conformed to the perimeter of the upper edge of the container 120 and is adapted to be seated on a ledge 171 formed in the inner surfaces of the container walls 121 to 123 and fixedly secured thereto as by ultrasonic welding. The top plate 170 has a large octagonal opening formed therein so that the top plate 170 essentially comprises a relatively narrow flange projecting horizontally inwardly from the walls of the container 120. Formed in the upper surface of the top plate 170 adjacent the rear edge thereof is a shallow recess 172 adapted to receive therein the retaining plate 118 fixedly to hold the container 120 in place in the mounting bracket 101. Two forward abutments 174 respectively extend upwardly from the top plate 170 adjacent the front corners thereof, the forward abutments 174 each having a notch 176 formed in the front surface thereof.

Four of the edges of the octagonal inner perimeter of the top plate 170 extend across the corners of the container 120 substantially at 45° angle to the adjacent walls thereof, one of these corner edges being substantially coplanar with the guide surface 169 of the vent tube 168. Integral with the top plate 170 respectively adjacent to the other three corner edges and extending downwardly therefrom are three positioning members 175, each having a stiffening rib 177 along the outer surface thereof, and each being provided with inner flat rectangular guide surface facing inwardly toward the well 155, and are respectively substantially coplanar with the adjacent corner edges of the top plate 170.

The container 120 is also provided with a cover plate, generally designated by the numeral 180, which includes a flat rectangular top wall 181, a front wall 182, a pair of opposed side walls 183 and a rear wall 184, all integrally connected in a unitary structure. Fixedly secured to the top wall 181 adjacent to the rear edge thereof is a key operated latch mechanism 185. Fixedly secured to the inner surface of the front wall 182 is an elongated bearing plate 186 provided at the opposite ends thereof with rearwardly extending fingers 187, each preferably covered with a resilient cushioning material, the fingers 187 being respectively adapted to be received in one of the notches 176 in the forward abutments 174 of the top plate 170. The cover plate 180 is dimensioned so as completely to cover the top wall 170 of the container 120, the walls 182 to 184 having a vertical extent sufficient to accommodate the inclined flange 108 and the upwardly extending flange 109 of the mounting bracket 101. In use, the fingers 187 are inserted into the notches 176 of the forward abutments 174, and the cover plate 180 is then pivoted down into position completely covering the top of the container 120, as illustrated in FIG. 3, a latch hook of the latch mechanism 185 engaging in a complementary shaped keeper opening (not shown) in the upwardly extending flange 109 of the mounting bracket 101.

Formed in the rear wall 123 of the container 120 is a vertical slot 190 that extends from just above the partition 150 to the top wall 170, for a purpose explained more fully hereinafter. It can be seen that the cover plate 180 cooperates with the partition 150 and the walls 121 to 123 of the container 120 to define a closed upper refill compartment, generally designated by the numeral 195, communication between the upper refill compartment 195 and the lower soap reservoir compartment 165 being provided by the refill aperture 161 through the hollow piercing member 160, and by the hollow vent tube 168.

Referring to FIGS. 2 through 5 of the drawings, there is illustrated a first form of a fluid refill pouch 200 for use with the dispenser 100 to provide a complete system for dispensing fluid, such as soap. The pouch 200 includes a flexible plastic wall 201 which is initially tubular in shape, other shapes being also usable, and which after filling with liquid soap 166, is sealed at each end as at 202 to provide a fluid-tight container 205 for the liquid soap.

Figure 4:
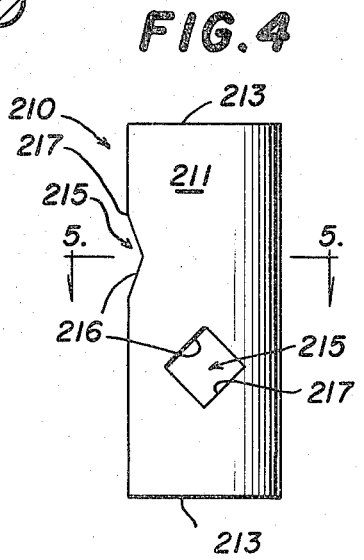
FIG. 4 is a side elevational view of a first form of a tubular docking adaptor forming a part of the fluid refill pouch of FIG. 2.
Figure 5:
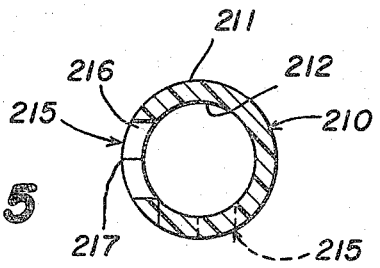
FIG. 5 is a view in horizontal section along the line 5—5 of FIG. 4.

Disposed within the container 205 and in the liquid soap 166 therein, is a tubular docking adaptor 210, see particularly FIGS. 4 and 5. The adaptor 210 is cylindrical in shape, circular in cross section, and includes an outer cylindrical wall 211 extending the length thereof and a cylindrical inner wall 212 also extending the length thereof. It will be appreciated that the adaptor 210 may be of cylindrical shape, and have a cross section other than circular, i.e., a cross section of a different shape such as octagonal, rectangular, etc. The adaptor 210 terminates at ends 213 at each end thereof, the ends 213 being disposed normal to the longitudinal axis of the tubular docking adaptor 210. The outer size or diameter of the outer wall 211 is slightly less than the inner size or diameter of the inner surface of the refill well 155, and more specifically, the difference in the diameters is slightly less than twice the thickness of the material forming the pouch wall 201, so that when the parts are in the positions illustrated in FIG. 3, a fluid-tight seal is provided between the inner surface of the pouch wall 201 and the outer surface of the outer wall 211, and between the outer surface of the pouch wall 201 and the inner surface of the refill well 155. The inner size or diameter of the inner wall 212 is greater than the lateral extent of the piercing member 160, so as to fit thereover. With the parts in the positions illustrated in FIG. 3, a portion of the pouch wall 201 has been forced by the adaptor 210 over the piercing member 160 so as to puncture the pouch wall 201 and to permit discharge of the contents of the refill pouch 200 through the refill passage 161 that extends centrally of the piercing member 160.

There are provided in the adaptor 210 two diamond-shaped drain openings 215 which are spaced from the adjacent end 213 by an equal and predetermined distance. Each of the diamond-shaped openings 215 has four edges 216, two of the edges 216 providing an intersection at the point 217 which is disposed a predetermined distance from the adjacent end 213 of the adaptor 210. More specifically, the point 217 is disposed away from the adjacent adaptor end 213 a distance such that point 217 is disposed well below the upper surface 153 of the partition 150 adjacent to the annular rim 158, and well into the refill well 155 when the parts are in the operative positions illustrated in FIG. 3. This arrangement of the drain openings 215 assures that the last portions of liquid soap in the pouch 200 are drained into the lower reservoir compartment 165 of the dispenser 100.

It is pointed out that the adaptor 210 is essentially symmetrical about a plane normal to the longitudinal axis of the adaptor 210 and intersecting the longitudinal midpoint of the adaptor 210. As a consequence, either of the ends 213 on the adaptor 210 may be inserted into the well 155 to empty the contents of the pouch 200 into the lower reservoir compartment 165. It also is noted that the drain openings 215 are circumferentially displaced 90° with respect to each other so as to strengthen the adaptor 210 as compared to a configuration wherein the drain openings 215 were in longitudinal alignment. It will be appreciated that the drain openings 215 can be circumferentially displaced greater than 90° and up to 180° while retaining the desirable characteristics of maximizing the mechanical strength of the tubular docking adaptor 210.

In a constructional example of the pouch 200, the wall 201 is formed of a plastic, a preferred plastic being polyethylene, having a thickness of about 1.5 mils. The thickness of the plastic may vary from as little as 1 mil. up to as much as 5 mils. while retaining the desirable characteristics of the refill pouch 200. The portion of the wall 201 forming the container 205 is preferably about 6"×7", and the seals 201 are preferably about $\frac{1}{8}$" wide. Other materials may be used in forming the wall 201 such as thin gauge metal, fluid-proof paper, and the like. The tubular docking adaptor 210 is also preferably formed of plastic, a preferred plastic being polyethylene plastic. The diameter of the outer wall 211 may be about $\frac{3}{4}$", while the diameter of the inner wall is slightly greater than ½", and the length of the adaptor 210 is about 3", while the longitudinal point-to-point distance of the drain openings 215 in the longitudinal direction is about ½".

The fluid refill pouch 200 may be used to replenish all types of fluids, and is specifically not limited to be used to replenish liquid soap. Other suitable fluids useful in the present invention are automotive oil, windshield wiper fluids, medical fluid, industrial metal cutting lubricants, chemical additives, etc.

Figure 2:
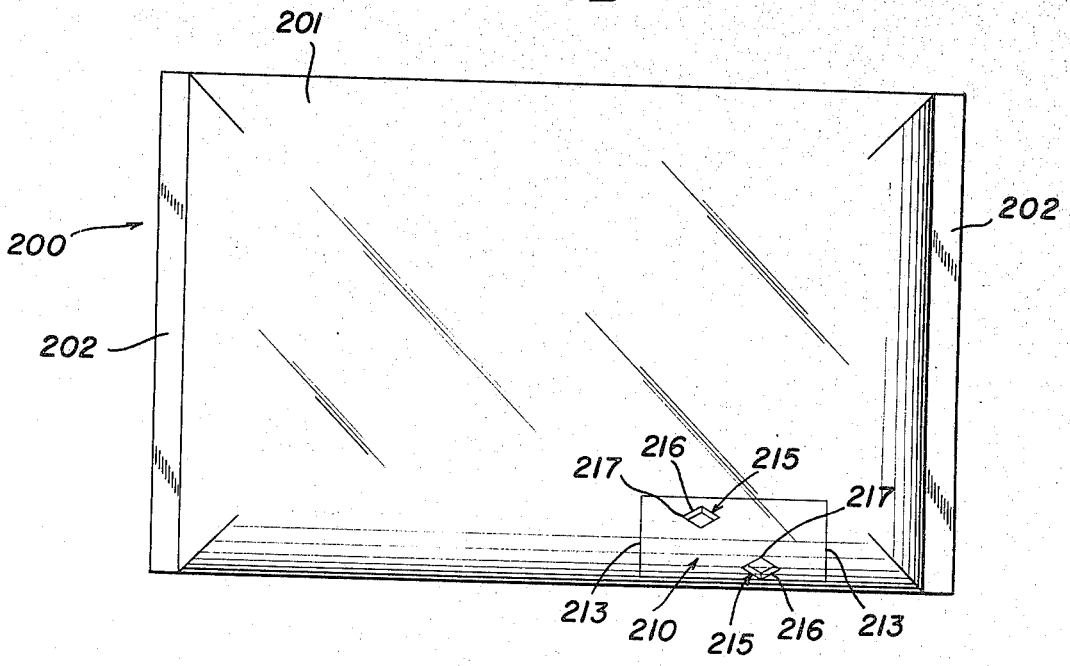
FIG. 2 is a plan view of a fluid refill pouch useful in the dispenser of FIG. 1.

In the use of the refill pouch 200 to replenish the soap 166 in the lower reservoir compartment 165, the user first lifts the pouch 200 in the condition illustrated in FIG. 2, and through the pouch wall 201 grasps the tubular docking adaptor 210 adjacent to one end thereof, folding a portion of the wall 201 over the outer end 213. The cover plate 180 has heretofore been removed from the dispenser 100 by operating the latch mechanism 185, and the empty refill pouch 200 disposed in the upper refill compartment 195 is removed therefrom. The aforementioned other end 213 of the adaptor 210 is then forcefully inserted into the refill well 155. The portion of the pouch wall 201 covering the other end 213 is pressed against the piercing member 160 and is pierced thereby as the adaptor 210 is driven home into the refill well 155, the parts eventually reaching the positions illustrated in FIG. 3. At this time, a portion of the wall 201 has been pierced as at 206, thus providing the communication between the interior of the refill pouch container 205 and the refill aperture or passage 161. It is noted that the portion of the pouch wall 201 surrounding the engaged end of the adaptor 210 assists in forming a seal between the outer wall 211 and the inner surface of the refill well 155. The pouch 200 is shaped and has a volume such that it can easily fit within the upper refill compartment 195 as is well illustrated in FIG. 3 of the drawings. As soap is required in the lower reservoir compartment 165, it will be drained from the pouch 200 through the passage 161, any air that need be displaced from the lower reservoir compartment 165 passing through the vent tube 168.

The drain openings 215 partially disposed in the refill well 155 facilitate the draining of the final portions of the contents of the refill pouch 200 therefrom and through the refill aperture 161 and into the lower reservoir chamber 165. When it is desired to remove the empty pouch 200, the cover plate 180 is removed, the adaptor 210 is grasped through the wall 201 and is pulled upwardly to remove the adaptor 210 and the associated portions of the pouch wall 201 from the refill well 155. The entire pouch 200, including the adaptor 210 is then discarded.

It will be appreciated that the pouch 200 can be stored in a minimum space, since the wall 201 thereof can be deformed so as closely to pack a container holding a plurality of pouches 200. Furthermore, the adaptor 210 is disposed completely within the pouch 200 and the soap 166 contained therein, whereby there is no objectionable protrusion which interferes with packing and storing of the pouch 200. In use, the construction of the pouch 200 and its adaptor 210 assure easy and tidy replenishment of the soap in the reservoir 165 by draining the contents of the pouch 200 through its adaptor 210 and the pierced portion 206 of the pouch wall 201, and thence through the refill aperture 161 and then into the lower reservoir compartment 165. Since the pouch 200 and all the components thereof including the adaptor 210 are disposable, there is a minimum of difficulty experienced by the user in disposing of the empty pouch 200 and its associated parts.

Referring to FIGS. 7 to 9 of the drawings, there is illustrated a second preferred embodiment of an adaptor 310 for use in a pouch 200 of the type discussed above. The adaptor 310 is generally cylindrical in shape, circular in cross section, and includes an outer cylindrical wall 311 and an inner cylindrical wall 312 extending the length thereof. The adaptor 310 terminates at ends 313 at each end thereof, the ends 313 being disposed normal to the longitudinal axis of the tubular docking adaptor 310. The outer diameter of the outer wall 311 is slightly less than the inner diameter of the inner surface of the refill well 155, and more specifically, the difference in the diameters is slightly less than twice the thickness of the material forming the pouch 200, so that when the parts are in the positions illustrated in FIG. 9, a fluid-tight seal is provided between the inner surface of the pouch wall 201 and the outer surface of the outer wall 311, and between the outer surface of the pouch wall 201 and the inner surface of the refill well 155. The inner diameter of the inner wall 312 is greater than the lateral extent of the piercing member 160 so as to fit thereover.

In order better to seal the space between the outer surface of the outer wall 311 and the inner surface of the refill well 155, annular flexible sealing means is provided adjacent to each end 313 of the adaptor 310 in the form of sealing ribs or flanges 320. The flanges 320 are separated by grooves 322 and the innermost flanges 320 are separated from the outer wall 311 by slightly wider grooves 323. The flanges 320 have relatively small longitudinal dimensions and the material of construction of the adaptor 310 is such that the flanges 320 are flexible and resilient to accomplish the sealing function thereof. With the parts in the position illustrated in FIG. 9, a portion of the pouch wall 201 has been forced by the adaptor 310 over the piercing member 160 so as to puncture the pouch wall 201 and to permit discharge of the contents of the pouch 200 through the refill aperture 161 in the center of the piercing member 160. The sealing flanges 320 serve to maintain a fluid-tight connection between the adaptor 310 and the side wall of the refill well 155.

There are provided in the adaptor 310 four oval-shaped drain openings 315 that extend from adjacent one end 313 to adjacent the other end 313. Each of the oval-shaped openings 315 has longitudinally extending side edges 316 joined by each end by a rounded end 317. Each of the rounded ends 317 is spaced from the adjacent adaptor end 313 by an equal and predetermined distance. More specifically, each of the drain opening ends 317 is disposed away from the adjacent adaptor end 313 a distance such that the rounded end 317 is disposed well below the upper surface 153 of the partition 150, and well into the refill well 155 when the parts are in the operative position illustrated in FIG. 9. This arrangement of the drain openings assures that the last portions of the liquid soap in the pouch 200 are drained into the lower reservoir compartment 165 of the dispenser 100.

It is pointed out that the adaptor 310 is symmetrical about a plane normal to the longitudinal axis of the adaptor 310 and intersecting the longitudinal midpoint of the adaptor 310. As a consequence, either of the ends 313 on the adaptor 310 may be inserted into the well 155 to empty the contents of the pouch 200 into the lower reservoir compartment 165. It also is noted that the drain openings 315 are circumferentially equidistantly displaced with respect to each other so as to strengthen the adaptor 310 as compared to any other configuration thereof.

In a constructional example of the tubular docking adaptor 310, it is preferably formed of plastic, the preferred plastic being polyethylene plastic. The diameter of the outer wall 311 is about $\frac{3}{4}''$, while the diameter of the inner wall is about $\frac{5}{8}''$, and the length of the adaptor 310 is about 3". The drain opening 315 has a longitudinal extent of $\frac{3}{4}''$ and a width at the greatest width thereof of $\frac{1}{4}''$. Each of the sealing flanges 320 has a longitudinal extent of 0.03", the grooves 322 have a longitudinal extent of about 0.10", and the grooves 323 have a longitudinal extent of about 0.16". The grooves 322 and 323 have depths of about 0.06".

The use of a pouch 200 provided with the adaptor 310 to supply soap for the lower reservoir compartment 160 is the same as that described above with respect to a pouch 200 with the adaptor 210. The only significant difference between the operation of the adaptor 210 and the operation of the adaptor 310 is the slightly better liquid-tight seal provided by the sealing flanges 320 on the adaptor 310. A pouch 200 provided with the adaptor 310 has all of the advantages and characteristics discussed above with the pouch 200 provided with an adaptor 210.

It is another important feature of the present invention that the soap dispenser 100 is usable only with the refill pouch 200 specifically designed therefor, so that the container 120 cannot be refilled with liquid soap from an unauthorized source. This purpose is furthered by the slot 190 in the rear wall 123 in the container 120. More particularly, it will be understood that by reason of the large dimensions of the refill passage 160 which permits free flow of liquid soap therethrough by gravity, there would be a temptation by unauthorized purveyors of liquid soap to simply pour free or bulk liquid soap into the refill compartment 195 and let it drain through the refill passage 160. If this is attempted, however, the soap will also immediately flow out through the slot 190, running down the back of the container 100, onto the bracket wall 111 along the outside of the pump assembly 130 creating a messy overflow and possible fouling the dispensing mechanism. Thus, it will be appreciated that the slot 190 effectively prevents accumulation of free liquid soap in the refill compartment 195.

If, however, during the replacement of the refill cartridge 200 some small quantities of liquid soap drips onto the partition 150, it will flow into the well 155 through the notches 159 in the annular rim 158 by reason of the sloping upper surface 153 of the partition 150. The soap will then gradually drain through the small drain holes 157 into the lower reservoir compartment 165.

From the foregoing, it will be seen that there has been provided an improved fluid dispensing system which includes a refillable fluid dispenser and a refill pouch therefor, such that there is permitted rapid servicing of the dispenser for refill thereof, while at the same time preventing refilling of the container with fluid from an unauthorized source.

There has also been provided an improved soap dispensing system of the character described, which permits a service man readily to determine by observation whether or not to refill the dispenser as needed, even in the case of an opaque dispenser.

While there has been described what at present are considered to be the preferred embodiments of the invention, it will be understood that various modifications may be made therein, and it is intended to cover in the appended claims all such modifications as fall within the true spirit and scope of the invention.

What is claimed is:

1. A system for dispensing fluid comprising a closed wall structure defining a container, partition means separating said container into a lower compartment and an upper compartment, dispensing means carried by said container for dispensing fluid from said lower compartment, said partition means having a refill well therein including a side wall portion extending into said lower compartment and an inner wall portion closing the inner end of said side wall portion, a piercing member carried by said inner wall portion and projecting therefrom into said refill well, said inner wall portion having a refill aperture therethrough providing direct communication between said lower compartment and said upper compartment, a fluid refill pouch removably enclosed within said upper compartment in a refill configuration, said fluid refill pouch including a flexible encompassing wall sealed to form a hollow flexible container with a quantity of fluid therein, and a docking adaptor initially loosely disposed within said pouch completely unrestrained with respect to the flexible encompassing wall of said pouch, said docking adaptor including an outer wall having an outer size slightly less than the inner size of said side wall portion of said refill well so as to fit thereinto with the flexible wall of said pouch disposed between the inner surface of said side wall portion of said refill well and the outer surface of said outer wall to form a seal therebetween, said docking adaptor including an inner wall having an inner size slightly greater than the lateral extent of said piercing member so that said docking adaptor can be pushed into said well and over said piercing member, a portion of said flexible wall overlying the end of said docking adaptor as it is inserted into said refill well receiving said piercing member in piercing relationship therethrough, whereby fluid may flow freely from said refill pouch through said refill aperture while being prevented from flowing around said docking adaptor disposed within said refill well and out of said refill well by the seal provided by the portion of said flexible wall disposed between the inner surfaces of said side wall portion and the outer surface of said outer wall.

2. The system for dispensing fluid set forth in claim 1, and further including a cover plate releasably mounted on said container closing the upper end of said upper compartment with said injection pouch disposed with said upper compartment.

3. The system for dispensing fluid set forth in claim 1, and further including a vent opening formed in said partition means for equalizing the pressure in said lower compartment and said upper compartment when said fluid refill pouch is disposed in said refill configuration.

4. The system for dispensing fluid set forth in claim 1, wherein said flexible encompassing wall is formed of a flexible plastic.

5. The system for dispensing fluid set forth in claim 1, wherein said tubular docking adaptor is formed of polyethylene plastic.

6. The system for dispensing fluid set forth in claim 1, wherein said docking adaptor is symmetrical about a plane normal to the axis thereof at the midpoint thereof, whereby either end of said docking adaptor may be inserted into said refill well.

7. The system for dispensing fluids set forth in claim 1, and further comprising a drain opening in said adaptor positioned to communicate with the end of said refill well disposed away from said inner wall portion of said refill well.

8. The system for dispensing fluid set forth in claim 1, wherein the inner surface of said side wall portion is circular in cross section, the outer wall of said docking adaptor is circular in cross section, and the inner wall of said docking adaptor is circular in cross section.

9. A system for dispensing fluid comprising a closed wall structure defining a container, partition means separating said container into a lower compartment and an upper compartment, dispensing means carried by said container for dispensing fluid from said lower compartment, said partition means having a refill well therein including a side wall portion extending into said lower compartment and an inner wall portion closing the inner end of said side wall portion, a piercing member carried by said inner wall portion, a piercing member carried by said inner wall portion and projecting therefrom into said refill well, said inner wall portion having a refill aperture therethrough providing direct communication betweeen said lower compartment and said upper compartment, a fluid refill pouch removably enclosed within said upper compartment in a refill configuration, said fluid refill pouch including a flexible encompassing wall sealed to form a hallow flexible container with a quantity of fluid therein, and a docking adaptor initially loosely disposed within said pouch completely unrestrained with respect to the flexible encompassing wall of said pouch, said docking adaptor including an essentially smooth cylindrical outer wall having an outer size slightly less than the inner size of said side wall portion of said refill well so as to fit thereinto with the flexible wall of said pouch disposed between the inner surface of said side wall portion of said refill well and the outer surface of said outer wall to form a seal therebetween, said docking adaptor including an inner wall having an inner size slightly greater than the lateral extent of said piercing member so that said docking adaptor can be pushed into said well and over said piercing member, a portion of said flexible wall overlying the end of said docking adaptor as it is inserted into said refill well receiving said piercing member in piercing relationship therethrough, whereby fluid may flow freely from said refill pouch through said refill aperture while being prevented from flowing around said docking adaptor disposed within said refill well and out of said refill well by the seal provided by the portion of said flexible wall disposed between the inner surfaces of said side wall portion and the outer surface of said outer wall.

10. The system for dispensing fluid set forth in claim 9, wherein the inner surface of said side wall portion is circular in cross section, said outer wall of said docking adaptor is circular in cross section, and said inner wall of said docking adaptor is circular in cross section.

11. The system for dispensing fluid set forth in claim 9, wherein said docking adaptor is symmetrical about a plane normal to the axis thereof at the midpoint thereof, whereby either end of said docking adaptor may be inserted into said refill well.

12. The system for dispensing fluid set forth in claim 9, and further comprising a drain opening in said docking adaptor positioned to communicate with the end of said refill well disposed away from said inner wall portion thereof.

13. The system for dispensing fluid set forth in claim 9, and further comprising two drain openings in said docking adaptor disposed adjacent respectively to each end thereof to communicate with the end of the refill well disposed away from said inner wall portion thereof when the adjacent end of said docking adaptor is disposed in said refill well.

14. The system for dispensing fluid set forth in claim 13, wherein said drain openings are angularly disposed with respect to each other about the circumference of said docking adaptor.

15. A system for dispensing fluid comprising a closed wall structure defining a container, partition means separating said container into a lower compartment and an upper compartment, dispensing means carried by said container for dispensing fluid from said lower compartment, said partition means having a refill well therein including a side wall portion extending into said lower compartment and an inner wall portion closing the inner end of said side wall portion, a piercing member carried by said inner wall portion and projecting therefrom into said refill well, said inner wall portion having a refill aperture therethrough providing direct communication between said lower compartment and said upper compartment, a fluid refill pouch removably enclosed within said upper compartment in a refill configuration, said fluid refill pouch including a flexible encompassing wall sealed to form a hollow flexible container with a quantity of fluid therein, and a docking adaptor initially loosely disposed within said pouch completely unrestrained with respect to the flexible encompassing wall of said pouch, said docking adaptor including an outer wall having an outer size slightly less than the inner size of said side wall portion of said refill well so as to fit thereinto with the flexible wall of said pouch disposed between the inner surface of said side wall portion of said refill well and the outer surface of said outer wall to form a seal therebetween, annular flexible sealing means projecting radially outwardly from said docking adaptor and being dimensioned and adapted to be received in said refill well in encircling relationship with said refill aperture and said piercing member and with sealing means pressing the adjacent flexible wall into sealing engagement with said side wall portion of said refill well, said docking adaptor including an inner wall having an inner size slightly greater than the lateral extent of said piercing member so that said docking adaptor can be pushed into said well and over said piercing member, a portion of said flexible wall overlying the end of said docking adaptor as it is inserted into said refill well receiving said piercing member in piercing relationship therethrough, whereby fluid may flow freely from said refill pouch through said refill aperture while being prevented from flowing around said docking adaptor disposed within said refill well and out of said refill well by the seal provided by the portion of said flexible wall disposed between the inner surfaces of said side wall portion and the outer surface of said outer wall.

16. The system for dispensing fluid set forth in claim 15, wherein said docking adaptor is symmetrical about a plane normal to the axis thereof at the midpoint thereof, whereby either end of said docking adaptor may be inserted into said refill well.

17. The system for dispensing fluid set forth in claim 15, and further comprising a drain opening in said docking adaptor communicating with the end of said refill well disposed away from said inner wall portion thereof.

18. The system for dispensing fluid set forth in claim 15, and further comprising four drain openings in said docking adaptor equidistantly spaced around the circumference thereof and each communicating with the end of said refill well disposed away from said inner wall portion thereof.

19. The system for dispensing fluid set forth in claim 15, and further comprising a drain opening in said docking adaptor extending to adjacent each end thereof, whereby a drain opening is provided for communicating with the end of said refill well disposed away from said inner wall portion thereof regardless of which end of said docking adaptor is inserted in said refill well.

20. The system for dispensing fluid set forth in claim 15, wherein the inner surface of said side wall portion is circular in cross section, said outer wall is circular in cross section, said flexible sealing means is circular in cross section, and said inner wall is circular in cross section.

* * * * *

UNITED STATES PATENT AND TRADEMARK OFFICE

CERTIFICATE OF CORRECTION

PATENT NO. : 4,316,555

DATED : February 23, 1982

INVENTOR(S) : Randel P. Smith

It is certified that error appears in the above-identified patent and that said Letters Patent are hereby corrected as shown below:

Column 13, line 26, "betweeen" should be --between--.

line 30, "hallow" should be --hollow--.

Signed and Sealed this

*Twenty-second* Day of *June 1982*

[SEAL]

*Attest:*

GERALD J. MOSSINGHOFF

*Attesting Officer*

*Commissioner of Patents and Trademarks*